United States Patent [19]

Appelt et al.

[11] Patent Number: 4,768,212

[45] Date of Patent: Aug. 30, 1988

[54] LIQUID-COOLED X-RADIATOR HAVING A CIRCULATION COOLING SYSTEM

[75] Inventors: Guenther Appelt, Erlangen; Josef Schmitt, Neunkirchen, both of Fed. Rep. of Germany

[73] Assignee: Siemens Aktiengesellschaft, Berlin and Munich, Fed. Rep. of Germany

[21] Appl. No.: 37,948

[22] Filed: Apr. 13, 1987

[30] Foreign Application Priority Data

Jun. 13, 1986 [DE] Fed. Rep. of Germany ... 8615918[U]

[51] Int. Cl.[4] ..... H01J 35/10

[52] U.S. Cl. ..... 378/141; 378/142; 378/130; 313/36

[58] Field of Search ..... 378/127, 130, 141, 199, 378/200, 142; 313/32, 36

[56] References Cited

U.S. PATENT DOCUMENTS

| | | | |
|---|---|---|---|
| 1,656,826 | 1/1928 | Morrison | 378/200 |
| 1,992,335 | 2/1935 | Tietig | 378/141 |
| 4,369,517 | 1/1983 | Ozawa . | |
| 4,674,109 | 6/1987 | Ono | 378/141 |

FOREIGN PATENT DOCUMENTS

| | | | |
|---|---|---|---|
| 73.03527 | 9/1973 | France . | |
| 60-112296 | 6/1985 | Japan . | |
| 60-112297 | 6/1985 | Japan . | |
| 2018019 | 10/1979 | United Kingdom . | |
| 0142249 | 5/1985 | United Kingdom | 378/130 |

OTHER PUBLICATIONS

"Medical X-Ray Technique," Philips Technical Library 1961, p. 34.

*Primary Examiner*—Carolyn E. Fields
*Assistant Examiner*—Joseph A. Hynds
*Attorney, Agent, or Firm*—Hill, Van Santen, Steadman & Simpson

[57] ABSTRACT

An x-radiator has a housing in which an x-ray tube is disposed surrounded by an electrically insulating coolant and having a circulation system for the coolant. The housing is substantially filled with the coolant, and a heat exchanger is disposed outside of the housing through which the coolant is pumped. *) The direction of flow of the coolant is automatically reversible dependent on the three-dimensional position of the x-radiator. *) For aiding in dissipating heat from said coolant a cooling fluid is circulated through the heat exchanger isolated from the coolant.

13 Claims, 1 Drawing Sheet

LIQUID-COOLED X-RADIATOR HAVING A CIRCULATION COOLING SYSTEM

BACKGROUND OF THE INVENTION

1. Field of the Invention

The present invention relates to a liquid cooled x-radiator, and in particular to a liquid cooled x-radiator having a circulation cooling means for the coolant.

2. Description of the Prior Art

A liquid cooled x-radiator is described in patent abstracts of Japan, Vol. 9, No. 266 (JP-A-No. 60 112 296 (Oct. 23, 1985) having a housing filled with an electriclly insulating coolant and a circulation means for the coolant. The housing has a radiation passage window and an x-ray tube disposed in the housing. The circulation means includes a cooler connected to the housing by two coolant lines and a circulating pump. The coolant circulation system is closed.

In this known structure, the circulation cooling means and the x-radiator are spatially separated from each other, thereby requiring considerable additional installation space. The necessity for such additional installation space poses particular problems if it is desired to incorporate such an x-radiator in an existing x-ray system. The circulation cooling means of this known x-radiator includes a blower for generating an air stream directed over a coolant line, however, this known x-radiator is unsuitable for uses wherein the x-ray tube is exposed to high loads, because the cooling capacity of the cooling means is not sufficient.

Another x-radiator of this type is described in Medical X-ray Technique, Philips Technical Library, 1961, page 34. In this structure as well, the circulation cooling means and the x-radiator are spatially separated from each other, so that the aforementioned disadvantages are present. The circulating cooling means in this x-radiator has an increased cooling capacity in comparison to the radiator disclosed in patent abstracts of Japan because the coolant is conducted into a reservoir wherein a cooling coil in which water flows is disposed. The cooling capacity of this system, however, is still not sufficient for all uses. Moreover, for undisturbed operation of the circulation cooling means, it is necessary that the reservoir is kept in a defined position, so that the circulation cooling means cannot be operated without regard to its position.

Another x-radiator is described in British Published Specification No. 2 018 019, wherein the cooling device is directly attached to the housing of the x-radiator. The cooler is in the form of a pipe coil disposed in the airstream of a blower, so that the cooling capacity which can be achieved is still insufficient. The same problems of installation space and position-dependent functioning of the circulation cooling means are also present.

SUMMARY OF THE INVENTION

It is an object of the present invention to provide an x-radiator having a circulation cooling means which forms a compact structural unit with the x-radiator and which exhibits a high cooling effect.

It is another object of the present invention to provide an x-radiator having such a circulation cooling means which is operable independent of its position.

The objects are achieved in accordance with the principles of the present invention in an x-radiator having a circulation cooling means directly attached to that housing of the x-radiator, wherein the cooler is a heat exchanger in which a cooling fluid flows, for example water, in addition to the coolant. The x-radiator and the circulation cooling means form a compact structural unit and the circulation cooling means exhibits a high cooling capacity as a result of the cooler being in the form of a heat exchanger. The x-radiator disclosed herein also has the advantage that only a small quantity of coolant is at any one time enclosed in the coolant circulation conduits, in comparison to conventional x-radiators, so that volume changes in the coolant caused by temperature fluctuations are slight. Means may be provided within the x-radiator for compensation of such slight volume changes in a simple manner.

In one embodiment of the invention, the housing is essentially a cylinder, and the circulation cooling means has an outside diameter substantially corresponding to that of the housing, and is disposed at an end face of the housing. The dimensions of the x-radiator having such a circulation cooling means are only slightly larger than the dimensions of a conventional x-radiator, so that the x-radiator disclosed herein can be installed in existing x-ray systems in place of conventional x-radiators.

The heat exchanger is preferably formed by a double-walled tube having an inner wall and an outer wall. An outer channel is formed between the inner wall and the outer wall, and an inner channel is formed in the interior of the inner wall. The coolant flows in one channel and the cooling fluid flows in the other channel. The installation space for such a heat exchanger is particularly low in an embodiment wherein the heat exchanger is a spirally wound coil. The tube can be provided with ribs at its outer surface for additional heat radiation.

In the embodiment wherein the heat exchanger is a double-walled tube of the type described above, the coolant can flow in the outer channel, and the cooling fluid can flow in the inner channel. Even in the event of interruption of the stream of cooling fluid, heat can still be eliminated by radiation by the heat exchanger functioning as a conventional cooler, and a blower for generating an air stream sweeping over the heat exchanger can be provided for such emergencies.

In a further embodiment of the invention the cooling effect can be further improved by arranging the discharge and return conduits for the coolant within the housing such that fresh coolant is introduced into the housing at those regions surrounding the x-ray tube which exhibit the highest temperature, so that the incoming stream of coolant is directed opposite to the thermal convection.

In another embodiment, means are provided for automatically reversing the direction of flow of the coolant stream, so that the x-radiation can be operated in any three-dimensional position without interrupting operation of the circulation cooling system and without impairing the cooling effect thereof.

DESCRIPTION OF THE PREFERRED EMBODIMENTS

Figure 1:
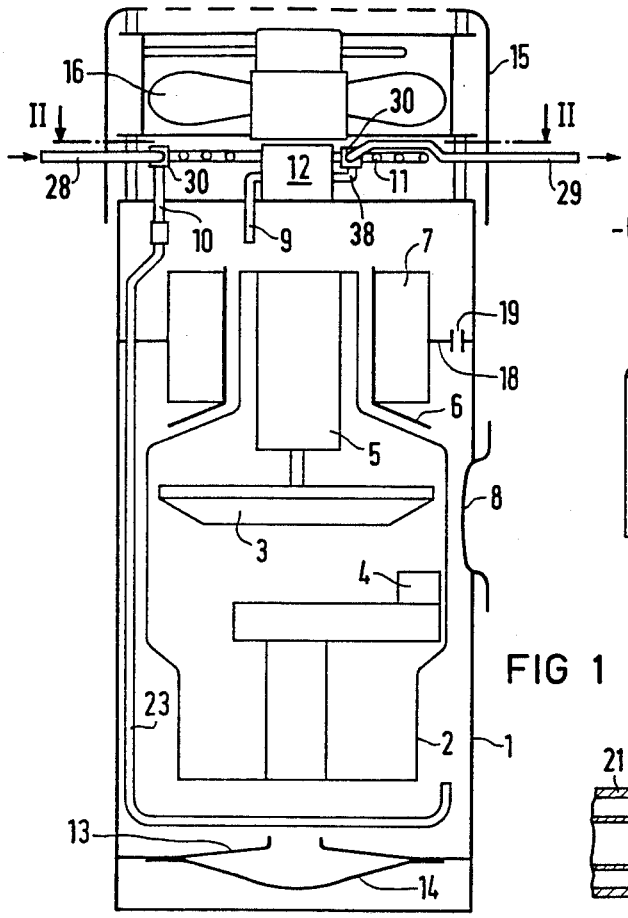
FIG. 1 is a side sectional view of an x-radiator having a circulation cooling system constructed in accordance with the principles of the present invention.

As shown in FIG. 1, an x-radiator constructed in accordance with the principles of the present invention has a housing 1 filled with an electrically insulating coolant, for example, insulating oil. An x-ray tube 2 is also disposed in the housing 1. In this embodiment, the x-ray tube 2 is a rotating anode x-ray tube having an anode dish 3, a cathode 4, and a motor for driving the rotating anode. The motor includes a rotor 5 and a stator 7 disposed on an insulator 6 outside of the glass envelope of the x-ray tube 2. The housing 1 has a radiation passage window 8 for x-radiation emanating from the anode dish 3.

The x-radiator has a circulation cooling means including a cooler 11 connected to the housing 1 by two coolant lines 9 and 10, and a circulating pump 12 for the coolant. The coolant circulation path is closed and the coolant lines 9 and 10 are conducted through a wall of the housing 1 in liquid-tight fashion.

A lateral wall 13 is also provided inside the housing 1, having a flexible membrane 14 which closes the interior of the housing 1 liquid-tight, and expands and contracts to compensate for temperature-caused volume fluctuations in the coolant.

Figure 4:
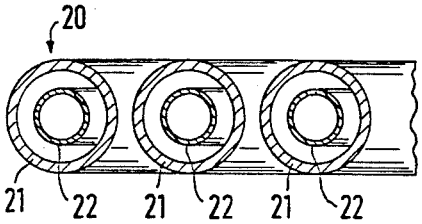
FIG. 4 is an enlarged detail, partly in section, of a portion of the heat exchanger in the x-radiator of FIG. 1.

The circulation cooling means is directly attached to the housing 1, which is essentially in the form of a cylinder. The circulation cooling means is attached to one end face of the housing 1 and is covered under a hood 15 provided with air slots. The outside diameter of the circulation cooling means thus substantially corresponds to that of the housing 1. As shown in FIG. 4, the cooler 11 may be a heat exchanger. The heat exchanger may be in the form of a double-walled tube 20 in which a cooling fluid flows as well as the coolant. The coolant may flow, for example, between an outer wall 21 and an inner wall 22, and the cooling fluid may flow in the interior of the inner wall 22. Even if circulation of the cooling fluid were to fail, a certain amount of heat elimination from the coolant due to the surrounding atmosphere is still possible through the outer wall 21 of the tube 20. Such heat elimination can be assisted by a blower 16.

Figure 2:
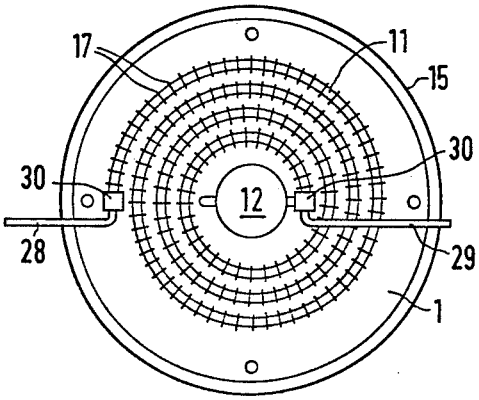
FIG. 2 is a sectional view of the x-radiator shown in FIG. 1 taken along line II—II.

As can be seen in FIGS. 2 and 4, the cooler 11 in the form of a heat exchanger is in the shape of a spirally wound coil, and may be provided with a plurality of exterior ribs 17 for assisting in heat radiation.

Figure 3:
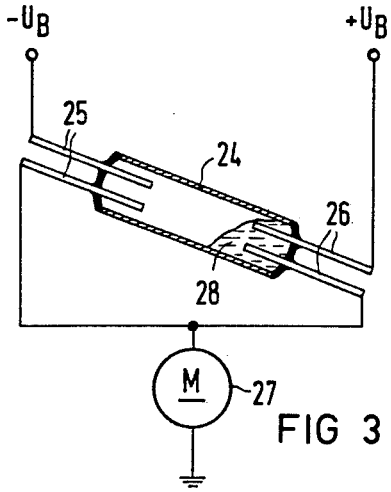
FIG. 3 is a schematic diagram of motor control circuitry for automatically reversing the flow of the coolant stream when the x-radiator changes position.

Those sections of the coolant lines 9 and 10 disposed outside of the housing 1 are in the form of substantially rigid pipes for safety reasons, and continue inside the housing 1 such that the coolant line 9 terminates in the region of the stator 7, and the coolant line 10, which in the interior of the housing 1 is in the form of a plastic hose 23, terminates in the region of the cathode and of the x-ray tube 2. When the x-radiator is operated in the postion shown in FIG. 1, i.e., with an upwardly directed circulation cooling means, it is preferable for the coolant to enter the housing 1 through the coolant line 9, because the freshly cooled coolant will then first flood the region of the x-ray tube 2 adjacent to the stator 7 which, as experience has shown, exhibits the highest temperature in this operating position of the x-radiator. For other operating positions of the x-radiator, it may be preferable to reverse the direction of the coolant stream. For this purpose, the pumping direction of the circulating pump 12 is reversible, and is automatically controlled dependent on the three-dimensional position of the x-radiator. This is accomplished by a mercury switch 24 as shown in FIG. 3 which is rigidly attached to the housing 1 (not shown in FIG. 3). The mercury switch 24 has two contacts 25 and 26 connected to a drive motor 27 for the circulating pump 12. One of the contacts is connected to a positive supply voltage $+U_B$ and the other contact is connected to a negative supply voltage $-U_B$. The mercury 28 flowable within the switch 24 will connect the motor 27 to either the positive or negative operation voltage, dependent on the position of the housing 1 and the switch 24. The motor 27 operates in opposite directions dependent upon whether it is connected to the positive or negative supply voltage, thus reversing the circulation direction of the coolant stream. In the embodiment of FIG. 3, the drive motor 27 is connected to the positive supply voltage $+U_B$.

A separate pump or other suitable circulation means is provided for the cooling fluid flowing in the outer channel of the double walled tube 20. This additional circulation means is connected to the structure of FIG. 1 via lines 28 and 29, which are respectively connected to the cooler 11 by connector members 30.

Figure 5:
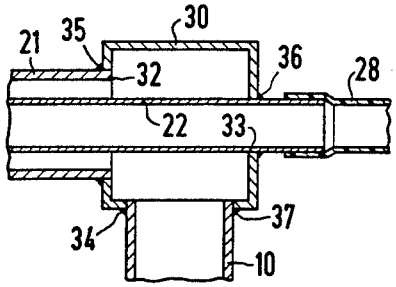
FIG. 5 is a side sectional view of a coupling element used in the x-radiator of FIG. 1.

Both connector members 30 are constructed identically, as shown in FIG. 5. The connector 30 has a hollow portion with three openings 32, 33 and 34 therein. The outer wall 21 of the cooler (heat exchanger) 11 discharges through the opening 32. The outer wall 21 is connected in liquid-tight fashion with the connector member 30, such as by solder 35. The inner wall 22 of the cooler 11 extends through the hollow interior of the connector member 30, and emerges therefrom through the opening 33, again sealed liquid-tight by solder 36. The hose 28 for the cooling fluid is connected to a portion of the inner wall 22 projecting from the connector member 30. The coolant line 10, leading into the interior of the housing 1 of the x-radiator, discharges through the opening 34, being connected to the connector member 30 in liquid-tight fashion by solder 37.

As a consequence of the structure of the connector member 30 and the manner by which the outer wall 21, the inner wall 22 and the coolant line 10 are connected thereto, a complete separation of the respective circulation paths for the coolant and for the cooling fluid is insured.

The other connector member 30 is identical to the above-described connector member, except that a cooling fluid hose 29 is connected thereto in place of the hose 28, and a line 38, leading to the pump 12 is connected in place of the coolant line 10.

Experience has shown that a so-called "heat pocket" forms in the gap between the insulator 6 and the glass envelope of the x-ray tube 2. In order to insure that a sufficiently large portion of the coolant stream is conducted through this gap, a diaphragm 18 is provided having relatively few flow openings 19 therein. The diaphragm 18 is disposed between the inside wall of the housing 1 and the outer circumference of the stator 7. The openings 19 of the diaphragm 18 are dimensioned such that only a relatively small portion of the coolant stream can flow therethrough, thereby requiring the relatively large remainder of the stream to pass through the gap between the insulator 6 and the glass envelope of the x-ray tube 2.

Although modifications and changes may be suggested by those skilled in the art it is the intention of the inventors to embody within the patent warranted hereon all changes and modifications as reasonably and properly come within the scope of their contribution to the art.

We claim as our invention:

1. An x-radiator comprising:

a housing having an x-ray tube disposed therein and filled with an electrically insulating coolant;

a heat exchanger disposed outside and adjacent to said housing, and being directly attached to said housing and having two coolant lines connected thereto extending into said housing;

a circulation pump connected to said heat exchanger for circulating coolant from said housing through said coolant lines and through said heat exchanger for dissipating heat therefrom; and means for circulating a cooling fluid through said heat exchanger separated from said coolant, said cooling fluid aiding in dissipating heat from said coolant.

2. An x-radiator as claimed in claim 1, wherein said housing is cylindrical, and wherein said heat exchanger is disposed at an end face of said housing, and said heat exchanger having an outside dimension substiantailly corresponding to the diameter of said housing.

3. An x-radiator as claimed in claim 1, wherein said heat exchanger is a double walled tube having an inner channel and an outer channel concentric therewith, said coolant flowing in one of said channels and said cooling fluid flowing in the other of said channels.

4. An x-radiator as claimed in claim 3, wherein said double walled tube is wound in a coil.

5. An x-radiator as claimed in claim 3, wherein said double walled tube has a plurality of exterior heat-radiating ribs attached thereto.

6. An x-radiator as claimed in claim 3, further comprising means for directing said coolant to flow in said outer channel and means for directing said cooling fluid to flow in said inner channel.

7. An x-radiator as claimed in claim 1, further comprising a blower disposed for generating an air stream which sweeps over said heat exchanger.

8. An x-radiator as claimed in claim 1, wherein said coolant lines terminate within said housing at respective locations for generating a coolant stream inside said housing such that fresh coolant from said heat exchanger first surrounds a region of said x-ray tube having the highest temperature.

9. An x-radiator as claimed in claim 8, wherein said circulating pump is reversible so as to reverse the direction of coolant flow within said housing.

10. An x-radiator as claimed in claim 9, further comprising means for automatically reversing the direction of operation of said circulating pump dependent on the three-dimensional position of said x-radiator.

11. An x-radiator as claimed in claim 10, wherein said circulating pump has a motor, and wherein said means for automatically reversing the direction of operation of said circulating pump is a mercury switch connected to respective positive and negative supply voltages, and connected to said motor.

12. An x-radiator comprising:

a housing having an x-ray tube disposed therein and filled with electrically insulating coolant;

a heat exchanger directly attached to said housing and having outside dimensions substantially corresponding to the dimensions of said housing, said heat exchanger having non-communicating first and second flow channels therein;

means including a circulating pump for communicating one of said flow channels with the interior of said housing for circulating said coolant within said housing and through said heat exchanger to remove heat therefrom; and means for circulating a cooling fluid through the other of said flow paths in said heat exchanger to assist in removing heat from said coolant.

13. An x-radiator comprising:

a housing having an x-ray tube therein and filled with electrically insulating coolant;

a heat exchanger having two non-communicating channels therein, one of said channels communicating through a pump with the interior of said housing through which said coolant is circulated to remove heat therefrom, and the other of said channels having a cooling fluid circulated therethrough for assisting in removing heat from said coolant; and means for automatically reversing the direction of operation of said pump and thereby reversing the direction of flow of said coolant in said housing dependent on the three-dimensional position of said x-radiator.

* * * * *